United States Patent [19]

Ohmori et al.

[11] 4,393,281

[45] Jul. 12, 1983

[54] DIP SWITCH

[75] Inventors: Hiroyuki Ohmori, Tokyo; Hiroshi Uchimura, Chiba; Yuzo Mikage, Funabashi, all of Japan

[73] Assignee: Matsu Kyu Kabushiki Kaisha, Japan

[21] Appl. No.: 293,977

[22] Filed: Aug. 18, 1981

Related U.S. Application Data

[63] Continuation-in-part of Ser. No. 94,488, Nov. 15, 1979, abandoned.

[30] Foreign Application Priority Data

Apr. 20, 1979 [JP] Japan ..... 54-53103[U]

[51] Int. Cl.[3] ..... H01H 15/02

[52] U.S. Cl. ..... 200/16 D

[58] Field of Search ..... 200/6 R, 6 B, 6 BA, 200/6 BB, 6 C, 16 R, 16 C, 16 D, 16 F, 291, 290, 302, 303, 1 R

[56] References Cited

U.S. PATENT DOCUMENTS 3,567,891 3/1971 Hinkelmann ..... 200/16 D X
3,974,347 8/1976 Lockard ..... 200/6 R
4,128,745 12/1978 Marsilio et al. ..... 200/16 C
4,132,874 1/1979 Bruni et al. ..... 200/16 F
4,168,404 9/1979 Lockard ..... 200/1 R

*Primary Examiner*—J. R. Scott
*Attorney, Agent, or Firm*—McGlew and Tuttle

[57] ABSTRACT

A dual inline package switch assembly containing one or more separate electrical switches is disclosed which comprises an insulating housing consisting of a base and a cover to provide an interior space. The cover has at least one slit extending into the interior space in alignment with the switch. At least one actuating member is movably provided within the interior space and is formed integrally with an operating stub positioned in the slit for selectively braking and making an electrical connection between a pair of contacts fixed on the base in aligned and spaced relation. The slit has a center neck whose width is slightly smaller than the diameter of the operating stub for detenting movement of the actuating member. The actuating member side walls is positioned on housing base rails to maintain constant pressure between the actuating member conductive bridging strip and fixed pair of contacts.

9 Claims, 14 Drawing Figures

DIP SWITCH

CROSS-REFERENCE TO RELATED APPLICATION

This application is a continuation-in-part of application Ser. No. 094,488, filed Nov. 15, 1979, now abandoned.

FIELD AND BACKGROUND OF THE INVENTION

This invention relates to improvements in a dual inline package switch assembly (hereinafter referred to as a DIP switch) for use in encoders, decoders, and other electronic computer components.

FIG. 1 is a sectional view showing a conventional DIP switch which comprises a housing including a switch case 1 and a base plate 2 enclosing the open bottom of the switch case 1. A fixed contact 3 is fixed on the base plate 2 and has its leg extending outwardly through the base plate 2. A movable contact 4 formed of a resilient metal plate has its leg extending outwardly through the base plate 2. A slider 5 is provided for sliding movement within the housing to bring the movable contact 4 into and out of contact with the fixed contact 3. The slider 5 has an operating knob 5*a* extending outwardly from its upper surface through an elongated slit 1*a* formed in the upper surface of the top wall of the switch case 1. The slider 5 has on its upper surface projections 5*b* which are selectively engaged in respective recesses 1*b* formed in the inner surface of the top wall of the switch case 1 when the switch is in open or closed state. Since the slider 5 is restrained from movement, due to engagement of one of the projections 5*b* in one of the recesses, the projection must be disengaged from the recess 1*b* with a relatively large force before the slider 5 is moved to cause the switch to be changed from the state to the other state.

With such a detent mechanism, vibrations occurring in the direction normal to the direction of movement of the slider 5, cause variations in the contact pressure between the fixed and movable contacts 3 and 4, which results in unstable switching operations.

FIG. 2 is a sectional view showing another conventional DIP switch which comprises a housing including a switch case 1 and a base plate 2 enclosing the open bottom of the switch case 1. A pair of fixed contacts 3 are fixed on the base plate 2 and have their legs extending through the base plate 2. Each of the fixed contacts 3 has a protruded end portion 3*a* which faces the protruded end portion of the other fixed contact in spaced relation. A slider 5 is provided for sliding movement within the housing and formed in its lower surface with a recess 5*d* containing therein a resilient short strip 4 having a protruded portion 4*a* which is engaged between the protruded end portions 3*a* of the fixed contacts 3 when the switch is in its closed state. Since the slider 5 is restrained from movement due to engagement of the protruded portion 4*a* of the short strip 4 between the protruded end portions 3*a* of the fixed contacts 3, the protruded portion 4*a* must be disengaged from the gap between the protruded portions 3*a* with a relatively large force when the switch is required to open.

The shortcoming, as described in connection with FIG. 1, is encountered with such a detent mechanism of FIG. 2.

FIG. 3 is a schematic view showing still another conventional DIP switch which comprises a base plate 2 formed of plastic or any other suitable resin, a pair of resilient contacts 3 and 4 having their legs 3*a* and 4*a* extending through the base plate 2 and supported to have their contact portions 3*b* and 4*b* held in pressure contact with each other, and a slider 5 having on its one side surface a projection 5*c* extending in the direction of movement of the slider 5 for insertion between the contact portions 3*b* and 4*b* to disconnect them.

One of the difficulties with such a conventional DIP switch is that the base plate 2 is subject to thermal deformation to change the relative position of the contacts when the contact legs 3*a* and 4*a* are soldered to electrical circuit openings. This causes reduction in contact pressure, which results in unstable switching operations.

FIG. 4A is a top plan view showing still another conventional DIP switch and FIG. 4B is a view partly in elevation and partly in section of the DIP switch of FIG. 4A. The DIP switch comprises a plurality of sliders 5 contained within a housing 1. Each of the sliders 5 has on its upper surface an operating knob 5*a* extending upwardly through a slot 1*a* formed on the upper wall of the housing 1. Since gaps G exist between the housing 1 and the sliders 5, detergent will enter into the switch housing 1 to cause troubles in switching operation when the switch is washed with a detergent after it is attached on a printed circuit board.

SUMMARY OF THE INVENTION

It is therefore one object of the present invention to provide an improved DIP switch which will be free from the above described disadvantages found in conventional DIP switches.

Another object of the present invention is to provide a DIP switch which is stable and reliable in operation.

Still another object of the present invention is to provide a DIP switch which can be washed with liquid detergent after it is attached to a printed circuit board.

According to the present invention, these and other objects are accomplished by a dual inline package switch assembly containing one or more separate electrical switches, which comprises an insulating housing consisting of a base and a cover and having an interior space in which at least one switch is positioned, the cover having in its top wall at least one elongated slit extending into the interior space in alignment with the switch; at least one pair of switch contacts having a first fixed arm extending on the base from one side of the housing, a second fixed arm extending on the base from the other side of the housing to face the free end of the first arm, and legs integrally with and extending from each arm from the respective sides of the housing for insertion into electrical circuit openings; at least one actuating means movably positioned within the interior space and having an operating stub positioned in the slit of the housing and having a resilient conductive bridging strip for selectively breaking and making an electrical connection between the fixed arms with movement of the actuating means; and the slit of the housing having a center neck whose width is slightly smaller than the diameter of the operation stub of the actuating means for detenting movement of the actuating means.

Other objects, means, and advantages of the present invention will become apparent to one skilled in the art thereof from the following description.

DESCRIPTION OF THE PREFERRED EMBODIMENT

Figure 1:
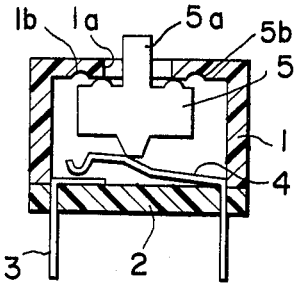
FIG.1 PRIOR ART
FIGS. 1 and 2 are sectional views showing different prior art conventional DIP switches.
Figure 2:
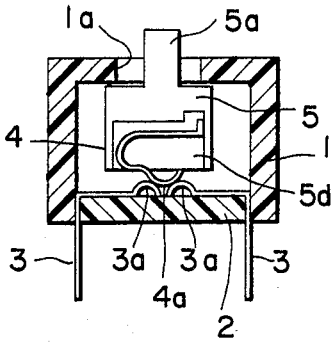
FIG.2 PRIOR ART
Figure 3:
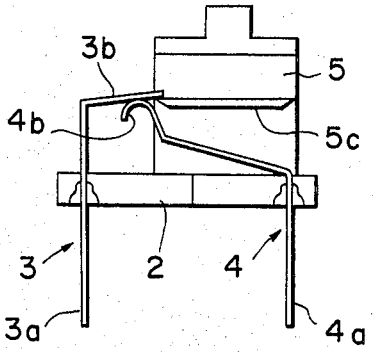
FIG.3 PRIOR ART
FIG. 3 is a schematic view showing another prior art conventional DIP switch.
Figure 4A:
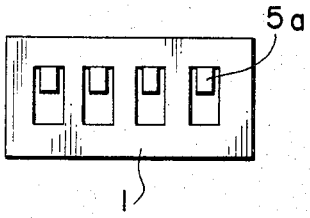
FIG. 4(A) PRIOR ART
FIG. 4A is a top plan view showing still another prior art conventional DIP switch.
Figure 4B:
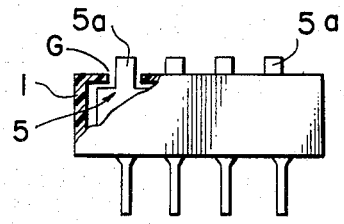
FIG.4(B) PRIOR ART
FIG. 4B is a view partly in elevation and partly in section of the prior art conventional DIP switch of FIG. 4A.
Figure 5:
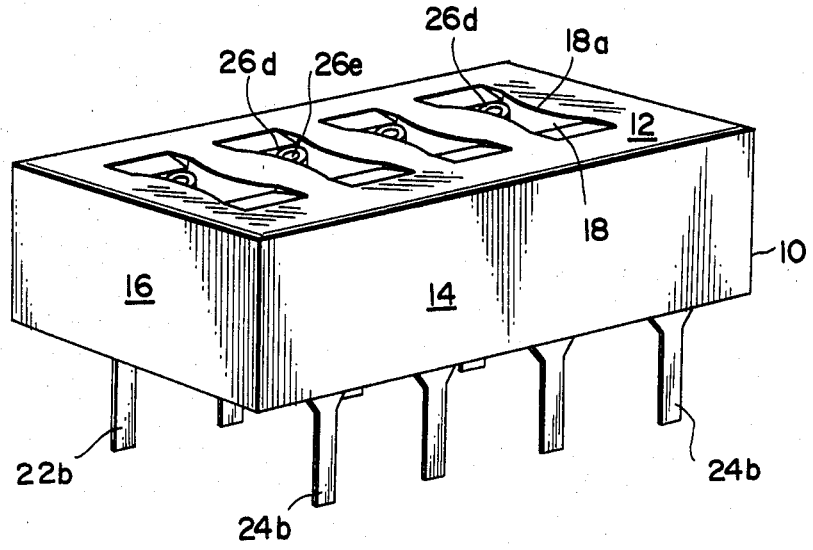
FIG. 5 is a perspective view showing one embodiment of a DIP switch made in accordance with the present invention.
Figure 6:
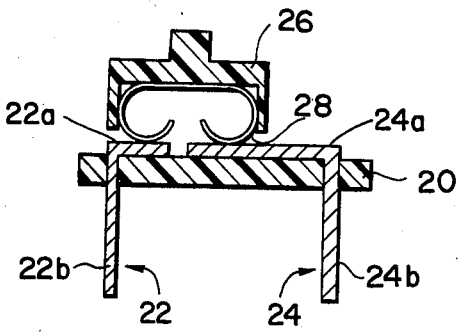
FIG. 6 is a sectional view taken along one switch contained in the DIP switch of FIG. 5.

Referring to FIGS. 5 and 6 there is illustrated one embodiment of a DIP switch made in accordance with the present invention. The DIP switch comprises an insulating switch cover 10 which consists of a top wall 12, spaced-apart side walls 14, and spaced-apart end walls 16. The top wall 12 is formed with a plurality of slits (in the illustrated case, four slits). The switch cover 10 has its open bottom enclosed with a base plate 20 made of heat resisting and organic-solvent resisting plastic or any other suitable resin. The DIP switch also comprises a plurality of pairs of fixed contact strips 22 and 24 each having, as a unit, a contact arm **22*a*, 24*a* fixed on the base plate 20, and an intermediate portion 22*b*, 24*b* extending outwardly through the base plate 20, which provides a contact leg for electrically connecting the contact to a circuit. Sliders, only one of which is shown at 26, are provided for sliding movement within the switch cover 10 to selectively connect and disconnect the respective pairs of contact arms 22*a* and 24*a***.

Figure 7:
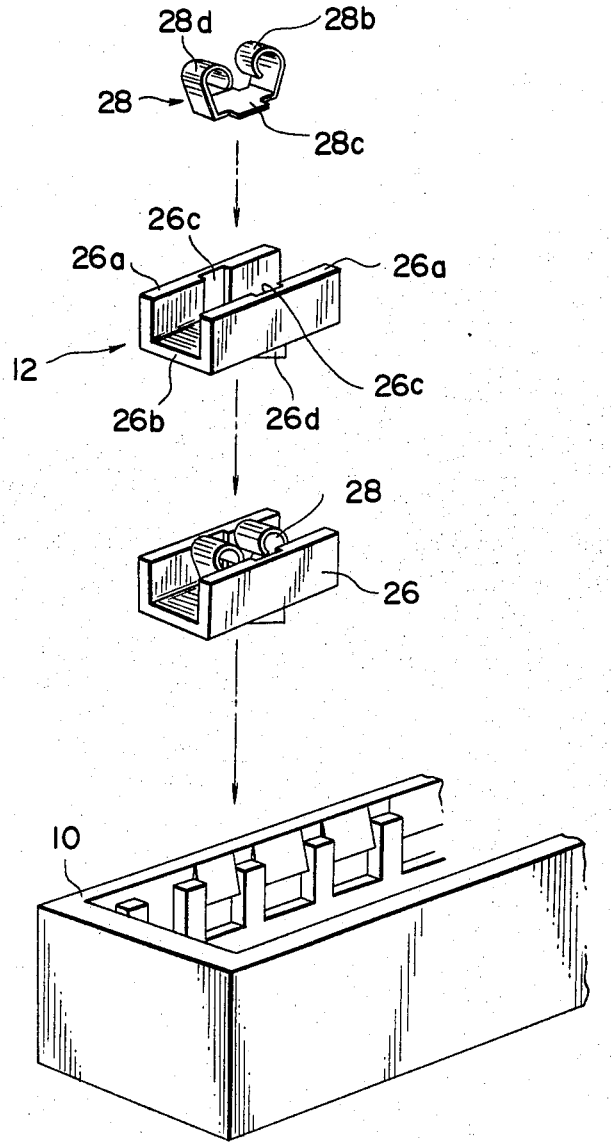
FIGS. 7 to 9 are exploded perspective views showing the components of the DIP switch of the present invention.
Figure 8:
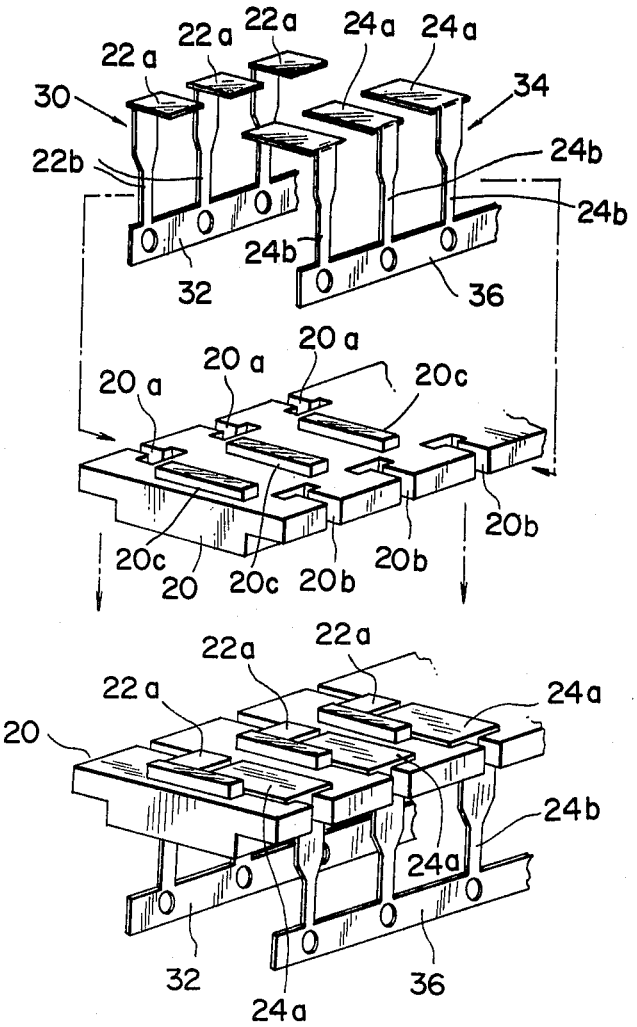
Figure 9:
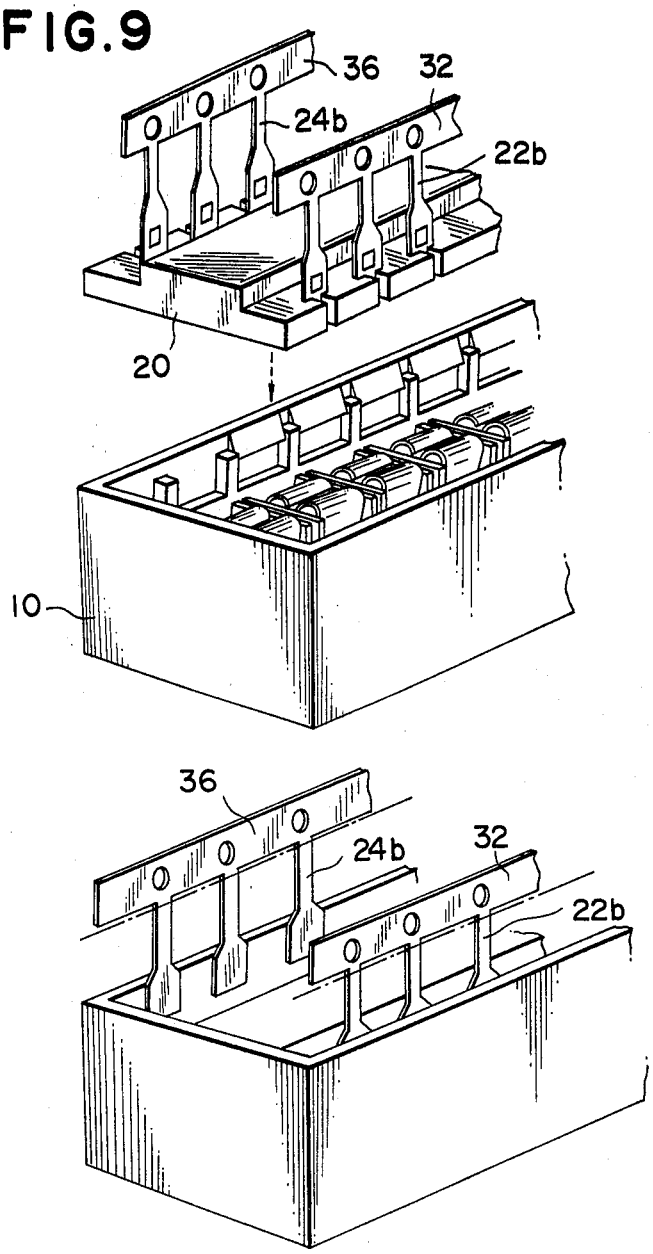

FIGS. 7, 8 and 9 are exploded perspective views showing the components of the DIP switch of the present invention. As shown in FIG. 7, each of the sliders 26 includes a cross sectionally U-shaped frame having two spaced-apart side walls **26*a* and a top wall 26*b* to provide an interior space. The side walls 26*a* are formed in their inner surfaces with recesses 26*c* which are intermediate the ends of the slider frame and face each other. The slider top wall 26*b* has on its outer surface an operating handle 26*d*. The interior space of the slider 26 receives a resilient bridging strip 28 which has rounded end portions 28*a* and 28*b* and outwardly extending wings 28*c* formed integrally intermediate the ends of the bridging strip 28. The wings 28*c* are engaged in the respective recesses 26*c* of the slider 26. The slider 26 is inserted into the switch cover 10 through the open bottom thereof and placed on its inner surface of the top wall 12 thereof with its operating stub 26*d* positioned in the slit 18**.

As shown in FIG. 8, a portion of a roll of resilient conductive material is stamped into a first contact member 30 which includes a plurality of contact strips 22 each having generally L-shaped configuration and a carrier strip 32 integrally joining the contact legs **22*b* of the contact strip 22. Each contact strip 22 has an intermediate portion 22*c* connecting the contact arm 22*a* to the contact leg 22*b* and is smaller in width than the contact leg 22*b*. A second contact member 34 is provided which is similar in structure to the first contact member 30 and which includes a plurality of contact strips 24 each having generally L-shaped configuration and a carrier strip 36 integrally joining the contact legs 24*b* of the contact strips 24**.

The base plate 20 is formed in its one side with T-shaped cutouts **20*a* arranged in longitudinal spaced relation and in the other side thereof with T-shaped cutouts 20*b* arranged in transverse alignment with the respective cutouts 20*a*. The first contact member 30 is attached and bonded to the base plate 20 with its intermediate portions 22*c* engaged in the respective cutouts 20*a*, and the second contact member 34 is attached and bonded to the base plate 20 with its intermediate portions 24*c* engaged in the respective cutouts 20*b* so that the respective pairs of contact arms can face each other with a gap. Extending on the base plate 20 in parallel spaced relation are rails 20*c* on which the sliders 26 are placed for sliding movement thereon. The rails 20*c* may be formed integrally with the base plate 20**.

As shown in FIG. 9, the base plate 20 with the first and second contact members 30 and 34 attached thereto is inserted into the switch case 10 through the open bottom thereof and attached thereto. The dash lines show where cutting will take place to provide the separated contact strips 22 and 24.

Figure 10:
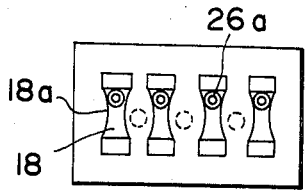
FIG. 10 is a top plan view of the DIP switch of the present invention.

FIG. 10 is a top plan view of the DIP switch of the present invention. It can be seen in FIG. 10 that each of the slits 18 is elongated in the direction of movement of the slider 26 and is defined by spaced-apart flat end surfaces and spaced-apart convexed surfaces to have a narrow portion **18*a* intermediate the ends thereof. The center neck 18*a* has a width slightly smaller than the diameter of the operating stub 26*d* of the slider 26 so that the slider 26 can be restrained from movement due to engagement of its operating stub 26 with the center neck 18*a*. Furthermore, each of the operating stub 26*d* of the slider 26 has a longitudinally extending center bore 26*e* for permitting resilient deformation of the operation stub 26*d* so that it can be pushed with a relatively large force to move over the center neck 18*a***. Such detent means can render the DIP switch free from contact pressure variations attendant upon vibrations in the direction normal to the direction of movement of the sliders.

Figure 11:
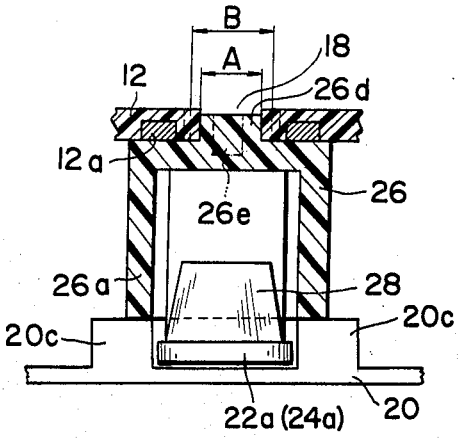
FIG. 11 is a fragmentary sectional view of FIG. 10.
Figure 12A:
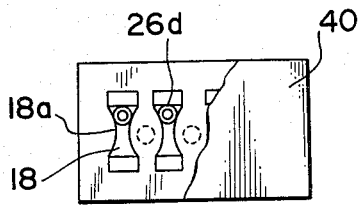
FIGS. 12A and 12B show a tape attached on the top surface of the DIP switch to cover the slits formed therein.
Figure 12B:
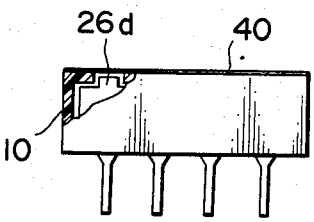

As shown in FIG. 11, the top wall 12 of the switch cover is formed on the opposite sides of the slits 18 with a plurality of grooves **12*a* extending in parallel with the slits 18 for more resilient deformation of the top wall 12 of the switch cover 10 to facilitate movement of the operating stubs 26*d* over the center necks 18*a* of the respective slits 18. The length of the operating stubs 26*d* is selected such as not to project from the outer surface of the top wall 12. This permits attachment of a solvent resisting tape 40 on the upper surface of the top wall 12 to cover the slits 18, as shown in FIGS. 12A and 12B, so as to prevent entrance of detergent into the housing during washing. Thus, it becomes possible to wash the DIP switch which is held attached on a printed circuit board. Each of the sliders 26 has its side wall 26***a* placed on a pair of rails 20*c* for sliding movement thereon This prevents the bridging strip 28 from moving toward the contact strip contact arms 22*a* and 24*a* and maintains constant the contact pressure between the bridging strip 28 and the contact strip contact arms 22*a* and 24*a* during movement of the slider 26 to turn the switch on and off. Thus, the bridging strip 28 is free from fatigue and is held in stable contact with the contact strip contact arms 22*a* and 24*a* under a pressure set initially, which results in ling useful switch life.

There has been provided, in according with the present invention, an improved DIP switch which is free from contact pressure variations due to vibrations attendant upon detenting and thermal deformation of contact support means, and which can be washed with detergent after it is attached to a printed circuit board. While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

While a specific embodiment of the invention has been shown and described in detail to illustrate the application of the principles of the invention, it will be understood that the invention may be embodied otherwise without departing from such principles.

What is claimed is:

1. A dual inline package switch assembly containing one or more separated electrical switches, comprising:

(a) an insulating housing having a base and a cover enclosing an interior space, at least one switch positioned in said interior space, said cover having a top wall with at least one elongated slit extending into said interior space in alignment with said switch;

(b) said switch including at least one pair of switch contacts having a first fixed arm extending on said base from one side of said housing, a second fixed arm extending on said base from the other side of said housing to face the free end of said first arm, and legs integral with and extending from each arm from the respective sides of said housing for insertion into electrical circuit openings, each arm being flat in a common plane and engaged against said base;

(c) said switch further including at least one actuating means movably positioned within said interior space and having an operating stub positioned in said slit of said housing and having a resilient conductive bridging strip for selectively breaking and making an electrical connection between said fixed arms with movement of said actuating means, said actuating means being displaceable onto said housing base for sliding movement thereon and said bridging strip having inwardly curved rounded end portions to maintain constant the pressure between said resilient conductive bridging strip and said fixed arms; and (d) said slit of said housing having a center neck whose width is slightly smaller than the diameter of said operation stub of said actuating means for detenting movement of said actuating means.

2. A dual inline package switch assembly according to claim 1, wherein said slit is defined by spaced-apart flat end surfaces and spaced-apart convexed side surfaces to have a narrow portion intermediate the ends thereof.

3. A dual inline package switch assembly according to claim 1, wherein said cover is formed in its top wall with grooves extending on the opposite sides of said slit.

4. A dual inline package switch assembly according to claim 1, wherein said operating stub has a length such as to not project from the upper surface of said top wall.

5. A dual inline package switch assembly according to claim 2, wherein said cover is formed in its top wall with grooves extending on the opposite sides of said slit, and wherein said operating stub has a length such as not to project from the upper surface of said top wall.

6. A dual inline package switch assembly according to claim 1, wherein said housing base has thereon at least a pair of rails and wherein said actuating means is placed on said rails for sliding movement thereon to maintain constant the pressure between said resilient conductive bridging strip and said fixed arms.

7. A dual inline package switch assembly according to claim 2, wherein said cover is formed in its top wall with grooves extending on the opposite slides of said slit.

8. A dual inline package switch assembly according to claim 7, wherein said operating stub has a length such as not to project from the upper surface of the top wall.

9. A dual in-line package switch assembly according to claim 4, wherein said stub includes a central bore extending therein for permitting resilient deformation of said stub as said stub moves past said central neck of said slit.

* * * * *